US008783926B2

(12) United States Patent
Suzuki

(10) Patent No.: US 8,783,926 B2
(45) Date of Patent: Jul. 22, 2014

(54) LAMP FOR VEHICLE

(75) Inventor: Hiroshi Suzuki, Yokohama (JP)

(73) Assignees: Hyundai Motor Japan R&D Center Inc., Seoul (KR); Hyundai Motor Company, Seoul (KR); Kia Motors Corporation, Yokohama (JP)

( * ) Notice: Subject to any disclaimer, the term of this patent is extended or adjusted under 35 U.S.C. 154(b) by 0 days.

(21) Appl. No.: 13/611,477

(22) Filed: Sep. 12, 2012

(65) Prior Publication Data

US 2013/0229817 A1 Sep. 5, 2013

(30) Foreign Application Priority Data

Mar. 2, 2012 (JP) ..... 2012-47066

(51) Int. Cl.
*F21S 8/10* (2006.01)

(52) U.S. Cl.
USPC ..... 362/545; 362/517; 362/249.02

(58) Field of Classification Search
USPC ..... 362/23.18, 3.19, 245, 249.01, 249.02, 362/249.06, 249.07, 298, 299, 300, 307, 362/326, 327, 328, 355–357, 507, 511, 514, 362/517, 518, 540–545, 800, 806; 359/839, 359/267
See application file for complete search history.

(56) References Cited

U.S. PATENT DOCUMENTS

| | | | | |
|---|---|---|---|---|
| 3,685,912 | A * | 8/1972 | Graig | 356/628 |
| 5,667,736 | A * | 9/1997 | Chien | 264/2.5 |
| 6,812,822 | B1 * | 11/2004 | Spector | 340/3.1 |
| 7,338,184 | B2 * | 3/2008 | Chen et al. | 362/246 |
| 7,540,106 | B2 * | 6/2009 | Weiss | 40/720 |
| 7,731,388 | B2 | 6/2010 | Hoelen et al. | |
| 7,891,844 | B2 * | 2/2011 | Schug et al. | 362/293 |
| 7,980,711 | B2 * | 7/2011 | Takayanagi et al. | 359/839 |
| 8,210,717 | B2 * | 7/2012 | Medendorp et al. | 362/249.02 |
| 8,475,020 | B2 * | 7/2013 | Dubosc | 362/517 |
| 2003/0067784 | A1 | 4/2003 | Erber | |
| 2006/0203484 | A1 | 9/2006 | Yu | |
| 2009/0016063 | A1 | 1/2009 | Hu | |

FOREIGN PATENT DOCUMENTS

| | | | | |
|---|---|---|---|---|
| EP | 1 835 225 | A1 | | 9/2007 |
| JP | 11-317104 | A | | 11/1999 |
| JP | 2002-75018 | A | | 3/2002 |
| JP | 2002-196108 | A | | 7/2002 |
| JP | 2003066873 | A | * | 3/2003 |
| JP | 2003-323805 | A | | 11/2003 |
| JP | 2009-87596 | A | | 4/2009 |
| KR | 10-2009-0082615 | A | | 7/2009 |
| KR | 10-0986400 | B1 | | 10/2010 |
| KR | 10-2011-0116891 | A | | 10/2011 |

* cited by examiner

*Primary Examiner* — Hargobind S Sawhney
(74) *Attorney, Agent, or Firm* — Morgan, Lewis & Bockius LLP

(57) ABSTRACT

A lamp apparatus for a vehicle may include a hollow tub having a mirror surface, an upper cover mounted at a side of the tub and having a first surface perpendicular to an axial direction of the tub, wherein the first surface includes a semi-mirror surface which divides light into a transmitted light passing to the outside and a reflected light reflected to the inside, a lower cover mounted at the other side of the tub and having a second surface perpendicular to the axial direction of the tub, wherein the second surface includes a mirror surface formed on an inner side thereof, and a plurality of point light sources mounted on the mirror surface of the lower cover, wherein light emitted from the point light sources is multiple-reflected between the semi-mirror surface of the upper cover and the mirror surface of the lower cover.

12 Claims, 14 Drawing Sheets

INNER SURFACE OF CYLINDER

PERSPECTIVE VIEW OF REAR SIDE

IN LIGHTING

IN LIGHTING

OVAL

PERSPECTIVE VIEW

LAMP FOR VEHICLE

CROSS-REFERENCE TO RELATED APPLICATION

The present application claims priority to Japanese Patent Application No. 2012-47066 filed Mar. 2, 2012, the entire contents of which is incorporated herein for all purposes by this reference.

BACKGROUND OF THE INVENTION

1. Field of the Invention

The present invention relates to a lamp for a vehicle. More particularly, the present invention relates to a lamp for a vehicle, in which the number of point light sources looks more than what they are actually mounted and shine like shooting stars.

2. Description of Related Art

Generally, a Light Emitting Diode (LED) is used for a vehicle lamp. FIG. 20 shows an example of a head lamp 10 using LED point light sources 3. Due to directivity and narrow radiation angle the LED, when a lamp is configured, a plurality of LEDs are disposed on a light emitting surface to extend a radiation area, increasing cost and power consumption. Therefore, it is desirable to elegantly illuminate the light emitting surface with a few point light sources and improve visibility through stereoscopic light emission rather than planar light emission.

A lighting module of Patent Document 1 disposes an LED on the bottom of a bowl-shaped reflector and provides a step on an inner surface of the reflector to reflect light emitted from the LED approximately in parallel to the front, allowing a point light source to be seen big. However, such a structure equally shines the light-emitting surface, and visibility is not excellent.

The information disclosed in this Background of the Invention section is only for enhancement of understanding of the general background of the invention and should not be taken as an acknowledgement or any form of suggestion that this information forms the prior art already known to a person skilled in the art.

SUMMARY OF THE DISCLOSURE

Various aspects of the present invention are directed to providing a lamp for a vehicle, in which the number of point light sources looks more than what they are actually mounted and shine like shooting stars.

In an aspect of the present invention, a lamp apparatus for a vehicle may include a hollow tub having an inner side which is a mirror surface, an upper cover which is mounted at a side of the tub and may have a first surface perpendicular to an axial direction of the tub, wherein the first surface may include a semi-mirror surface which divides light into a transmitted light passing to the outside and a reflected light reflected to the inside, a lower cover which is mounted at the other side of the tub and may have a second surface perpendicular to the axial direction of the tub, wherein the second surface may include a mirror surface formed on an inner side thereof, and a plurality of point light sources mounted on the mirror surface of the lower cover, wherein light emitted from the point light sources is multiple-reflected between the semi-mirror surface of the upper cover and the mirror surface of the lower cover.

The point light sources are spaced each other.

The upper cover is formed in a concave shape toward the lower cover and the first surface is formed of an annular end portion having the semi-mirror surface, wherein the first surface is formed with a plurality of annular end portions and aligned in a stepped shape, and wherein the second surface of the lower cover is flat.

The upper cover is formed in a convex shape in a direction opposite to the lower cover and the first surface is formed of an annular end portion, wherein the first surface is formed with a plurality of annular end portions and aligned in a stepped shape, and wherein the second surface of the lower cover is flat.

The lower cover is formed in a convex shape toward the upper cover and the second surface is formed of an annular end portion, wherein the second surface is formed with a plurality of annular end portions and aligned in a stepped shape.

The upper cover is flat, wherein the lower cover is formed in a convex shape toward the upper cover and the second surface is formed of an annular end portion and wherein the second surface is formed with a plurality of annular end portions and aligned in a stepped shape.

Other aspects and preferred embodiments of the invention are discussed infra.

The above and other features of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
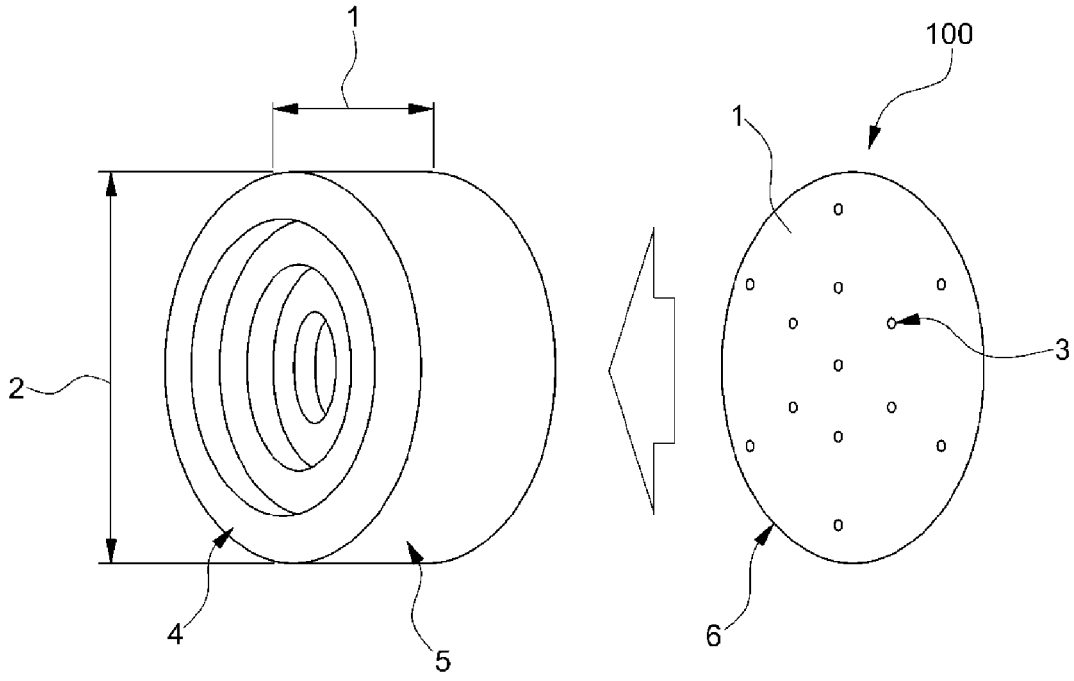
FIG. 1 is a structural diagram of a lamp for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a lamp for a vehicle according to an exemplary embodiment of the present invention will be described in more detail with reference to the accompanying drawings.

FIG. 1 is a structural diagram of a lamp 100 for a vehicle according to an exemplary embodiment of the present invention. The lamp 100 includes an upper cover 4, a tub 5, and a lower cover 6. The tub 5 is in a cylindrical shape, and its inner side is a mirror surface 1 formed by depositing chrome onto a transparent member. In this case, the tub 5 has a mirror surface also on its outer side. The upper cover 4 is mounted at a side of the tub 5. The upper cover 4 is formed in a concave shape having an annular end portion to form a stepped shape. The end portion has an annular surface which is perpendicular to the axial direction of the tub 5. The upper cover 4 includes, by chrome deposition, a semi-mirror surface 2 which divides light into a transmitted light passing to the outside and a reflected light reflected to the inside. The lower cover 6 is mounted at the other side of the tub 5. The lower cover 6 is a circular plate, and has a flat surface which is perpendicular to the axial direction of the tub 5. The lower cover 6 has an inner side which is the mirror surface 1 by chrome deposition. Thirteen point light sources 3 are attached onto the mirror surface 1 of the lower cover 6. The number of point light sources 3 is not limited to 13. The point light sources 3 according to an exemplary embodiment of the present invention are Light Emitting Diodes (LEDs) having high luminance and directivity, but they may also be small light bulbs.

Figure 2:
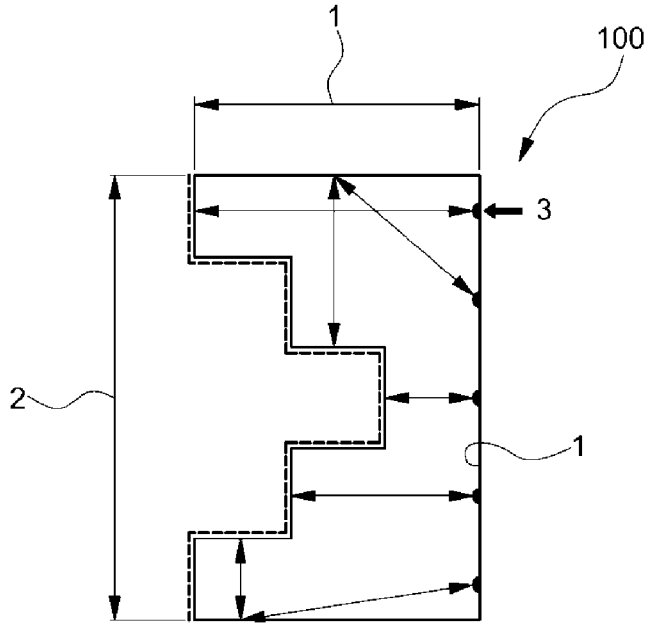
FIG. 2 is a longitudinal-sectional diagram of FIG. 1.

FIG. 2 is a longitudinal-sectional diagram of FIG. 1. Light emitted from the point light sources 3 are irradiated toward the left side of FIG. 2. The end portion of the upper cover 4 and the surface of the lower cover 6 are flat in parallel with each other, such that some portion of the light of the point light sources 3 going into the semi-mirror surface 2 goes outside and some other portion thereof is reflected and returns to the mirror surface 1. The returning light is reflected again from the mirror surface 1. Through repetition of this process, multiple reflections are achieved. Since the end portion of the upper cover 4 and the surface of the tub 5 are flat and in parallel with each other, the light going between them is also multiple-reflected.

Figure 3:
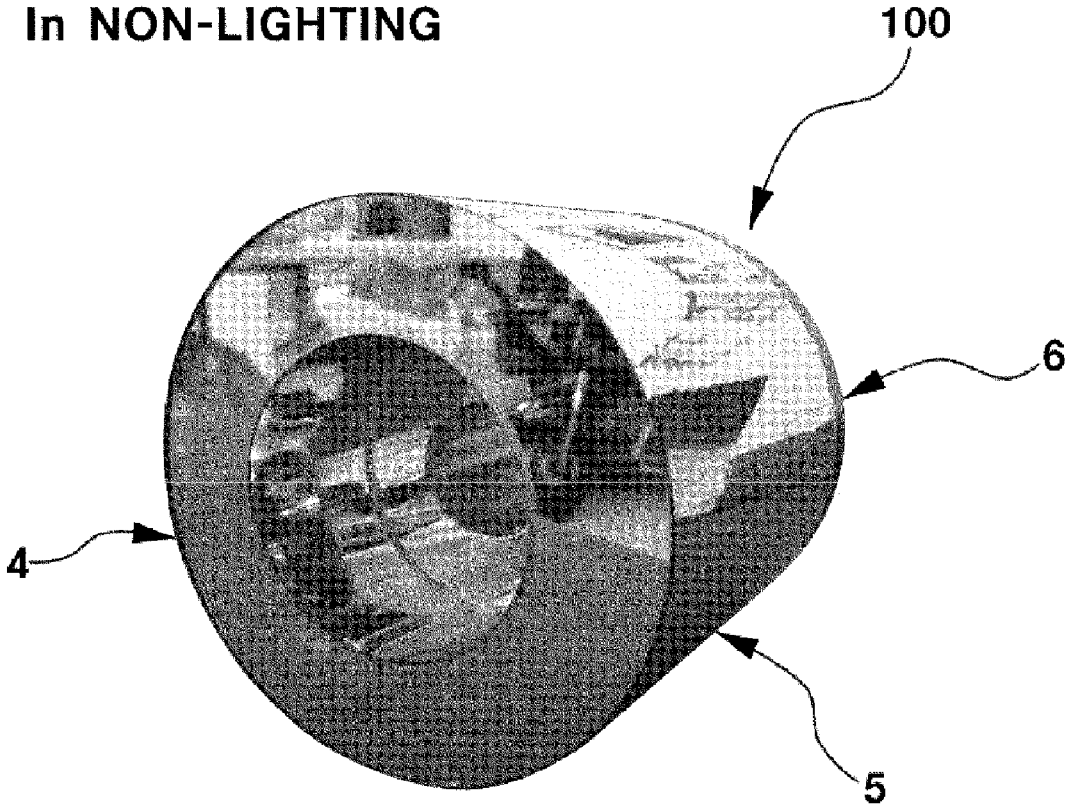
FIG. 3 is an exterior diagram of FIG. 1.
Figure 4:
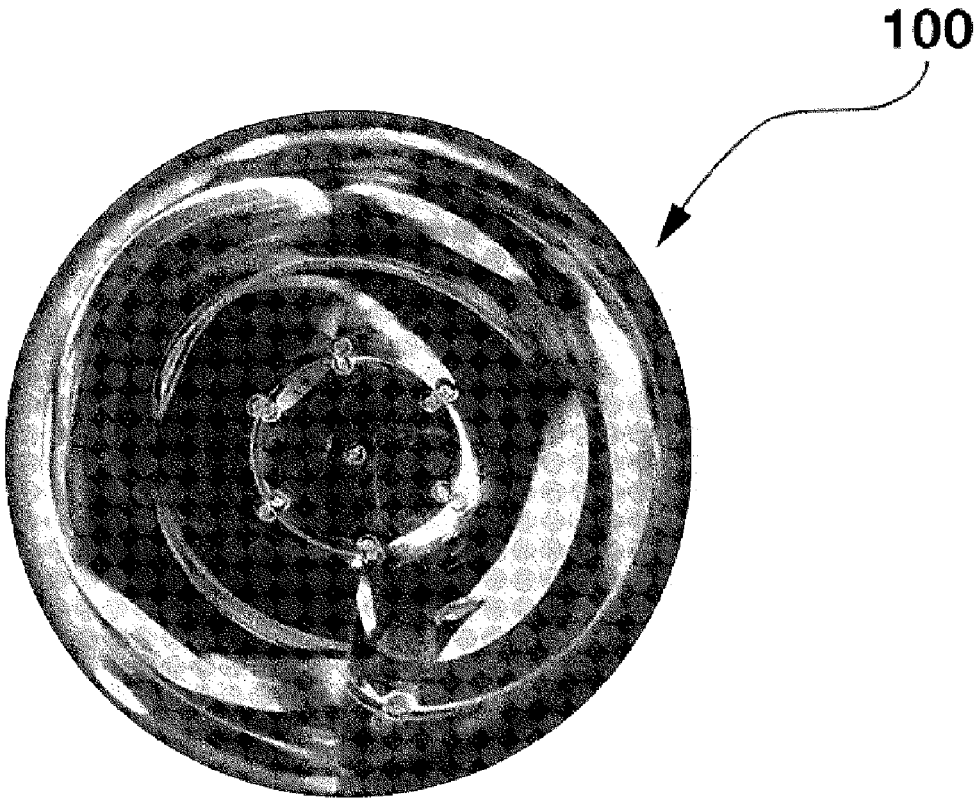
FIG. 4 is an interior diagram in which a lower cover of FIG. 1 is removed.
Figure 5:
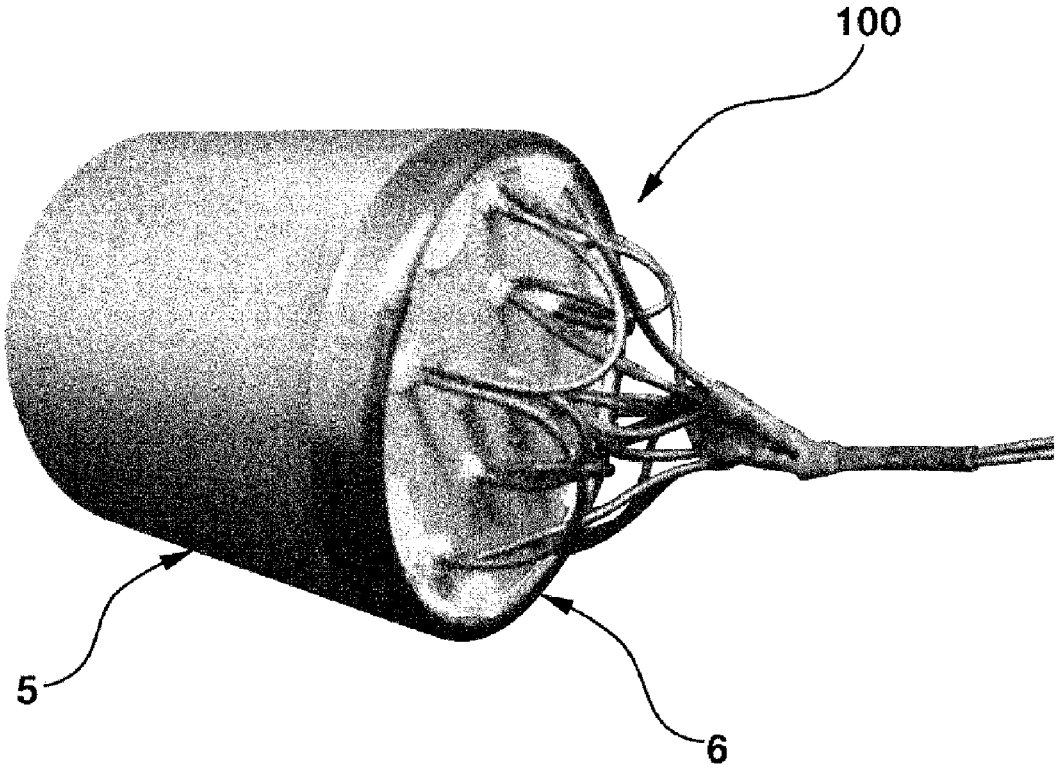
FIG. 5 is an exterior diagram of FIG. 1, viewed from a rear side.

FIG. 3 is an exterior diagram of the lamp 100 for a vehicle. FIG. 4 is an interior diagram in which the lower cover 6 is removed, in which an image reflected onto the mirror surface 1 of the inner side of the tub 5 looks like a flowing image. FIG. 5 is an exterior diagram of FIG. 1, viewed from a rear side, in which wires of the point light sources 3 are exposed on the rear side.

Figure 6:
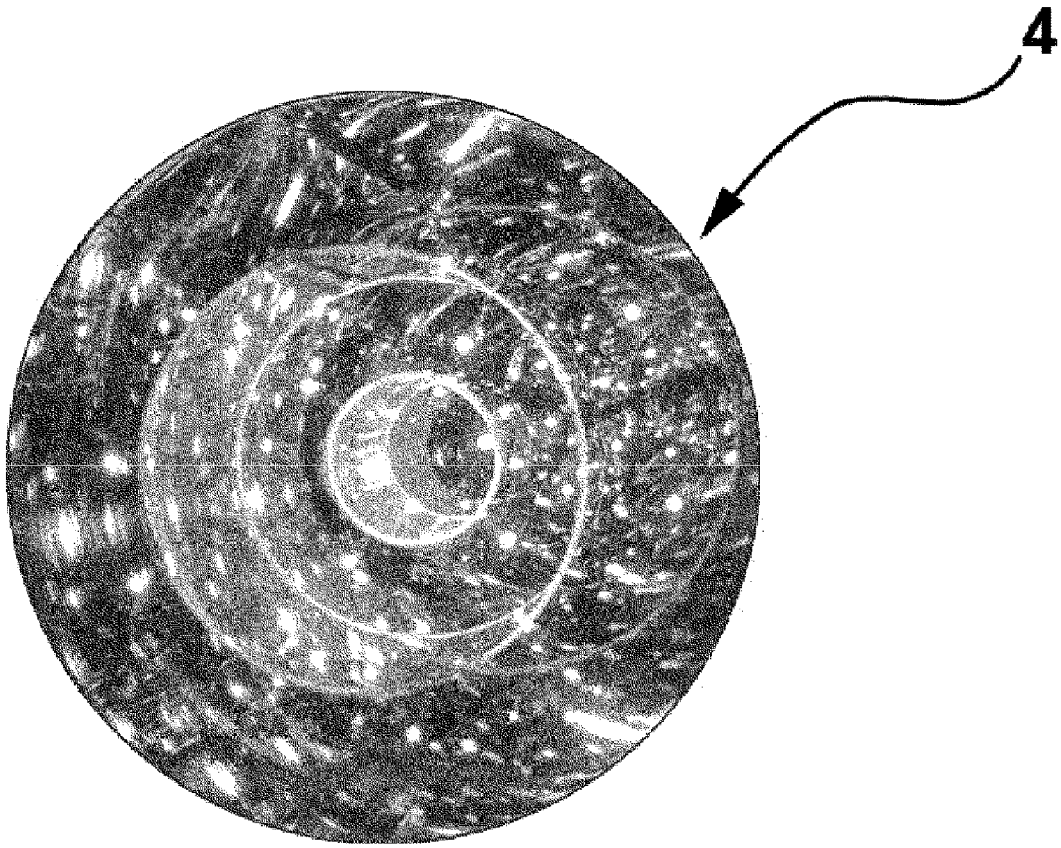
FIG. 6 is a diagram showing a light-emitting surface with lighting on in FIG. 1.
Figure 7:
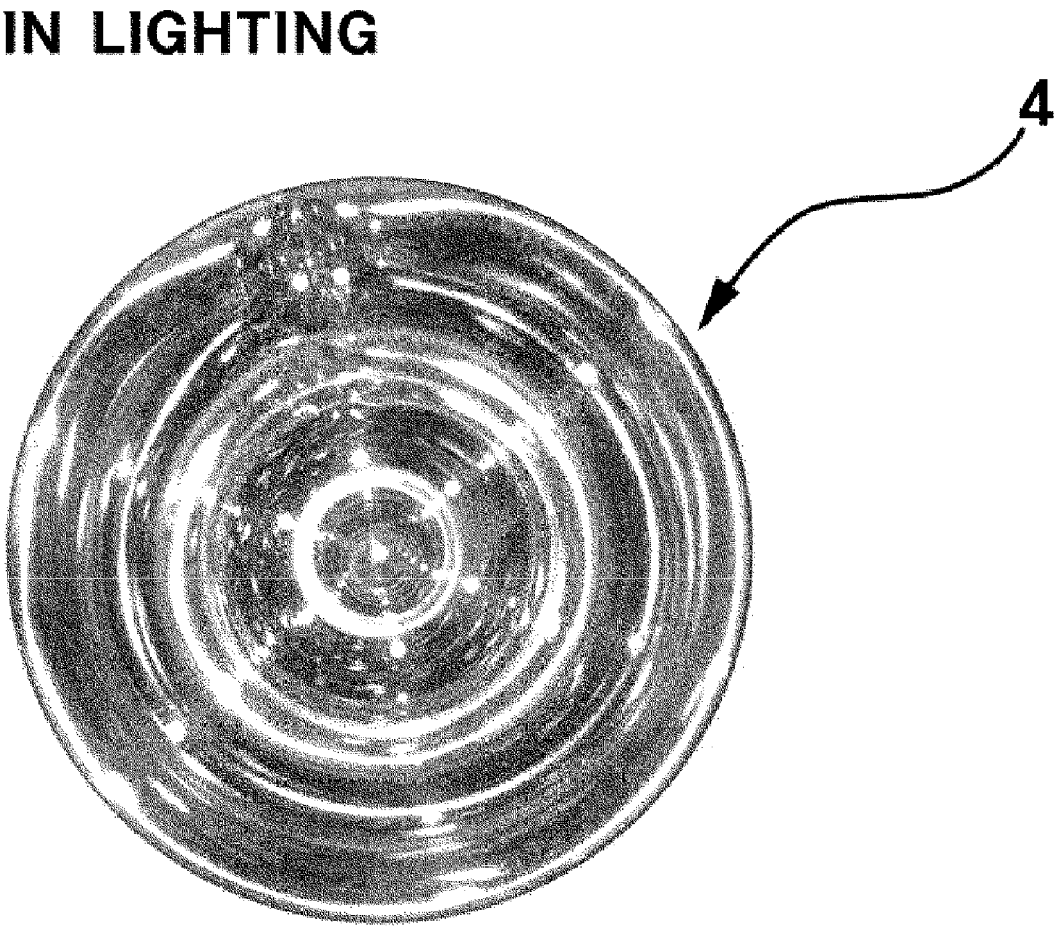
FIG. 7 is a diagram showing a light-emitting surface with lighting on in FIG. 1.
Figure 8:
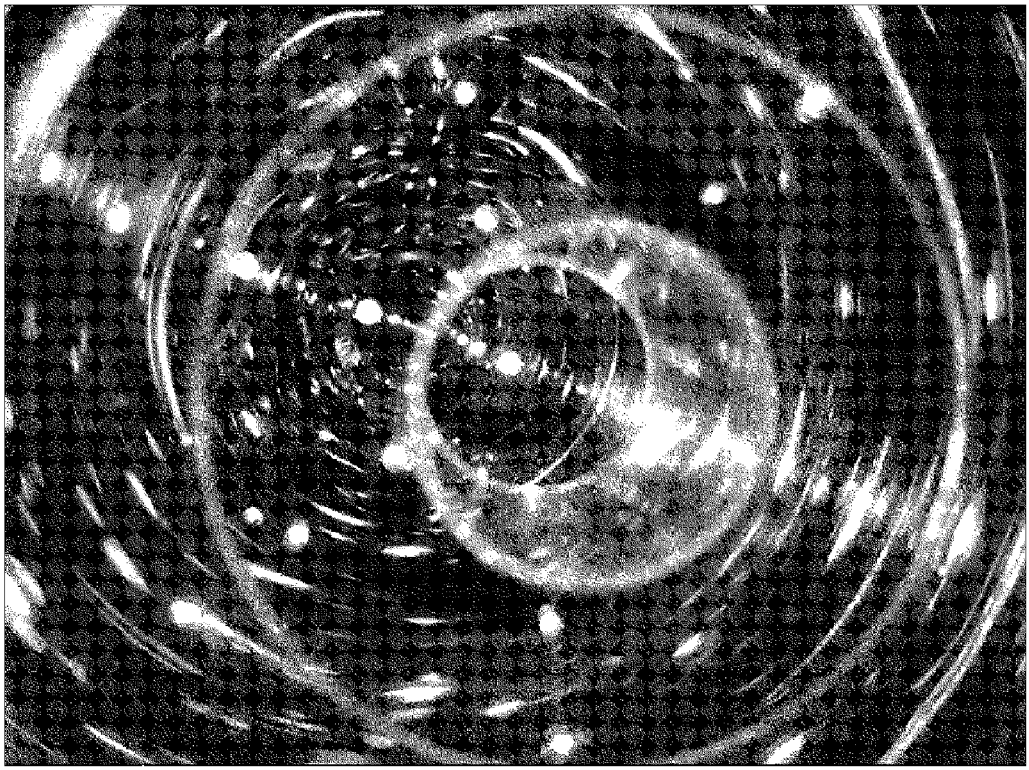
FIG. 8 is an enlarged diagram showing a light-emitting surface with lighting on in FIG. 1.

FIG. 6 is a diagram showing a light-emitting surface in lighting of the lamp 100 for a vehicle. FIG. 7 is a diagram showing a light-emitting surface with lighting on. FIG. 8 is an enlarged diagram showing a light-emitting surface with lighting on. FIGS. 6 and 8 show the light-emitting surface viewed in an inclined direction, and a plurality of light beams shine like shooting stars. The light beams of the point light sources seem to be more than 13 corresponding to the mounted point light sources. FIG. 7 is a diagram showing a light-emitting surface viewed from the front, in which the light forms an annular image flowing like a fluid.

Figure 9:
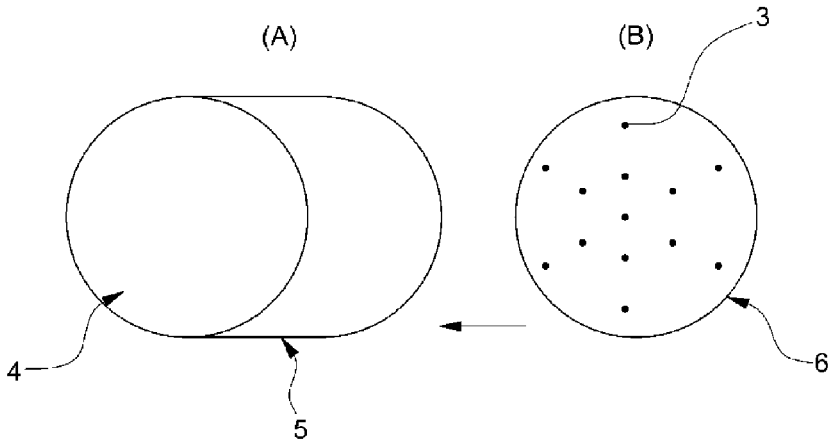
FIG. 9 shows an example in which an upper cover, a tub, and a lower cover have different shapes than in FIG. 1.
Figure 10:
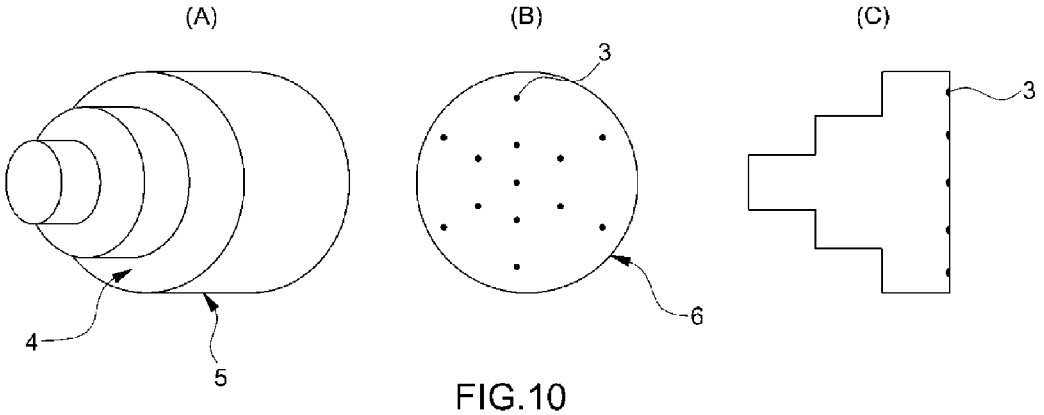
FIG. 10 shows another example in which an upper cover, a tub, and a lower cover have different shapes than in FIG. 1.
Figure 11:
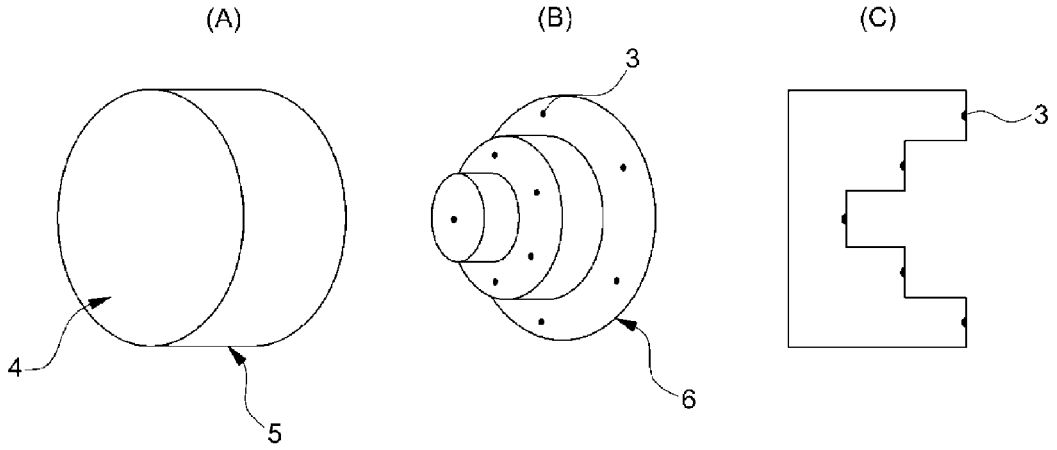
FIG. 11 shows another example in which an upper cover, a tub, and a lower cover have different shapes than in FIG. 1.
Figure 12:
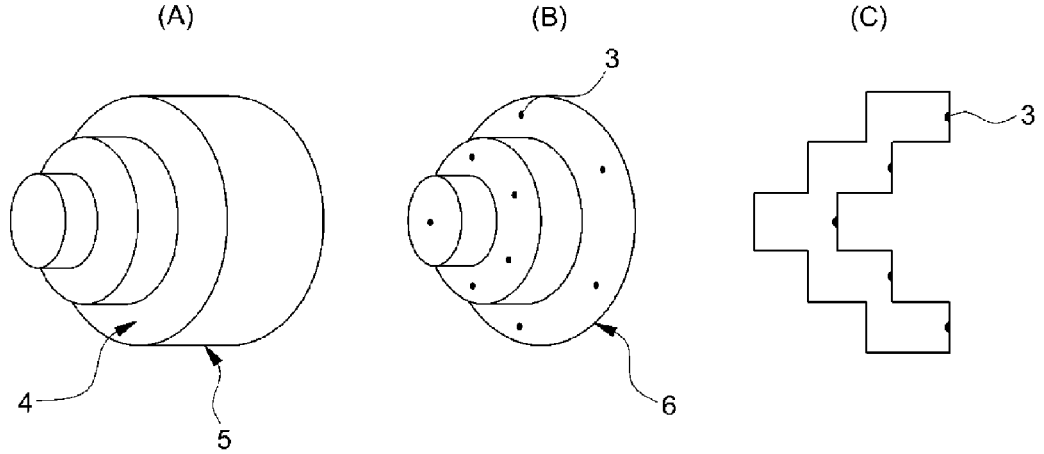
FIG. 12 shows another example in which an upper cover, a tub, and a lower cover have different shapes than in FIG. 1.

FIGS. 9 through 12 show examples in which the upper cover 4, the tub 5, and the lower cover 6 have shapes different from those of FIG. 1. In FIGS. 9 through 12, (A) shows the upper cover 4 and the tub 5, (B) shows the lower cover 6, and (C) shows a longitudinal section. The upper cover 4 and the tub 5 may be integrally formed as one piece. In FIG. 9, both the upper cover 4 and the lower cover 6 are flat circular plates. In FIG. 10, the upper cover 4 is in a convex shape having an end portion, and the lower cover 6 is a flat circular plate. In FIG. 11, the upper cover 4 is a flat circular plate, and the lower cover 6 is in a convex shape having an end portion to form a stepped shape. In FIG. 12, both the upper cover 4 and the lower cover 6 are in convex shapes having stepped end portions, respectively. With such shapes, the lamp for a vehicle, which shines like shooting stars, can be realized.

Figure 13:
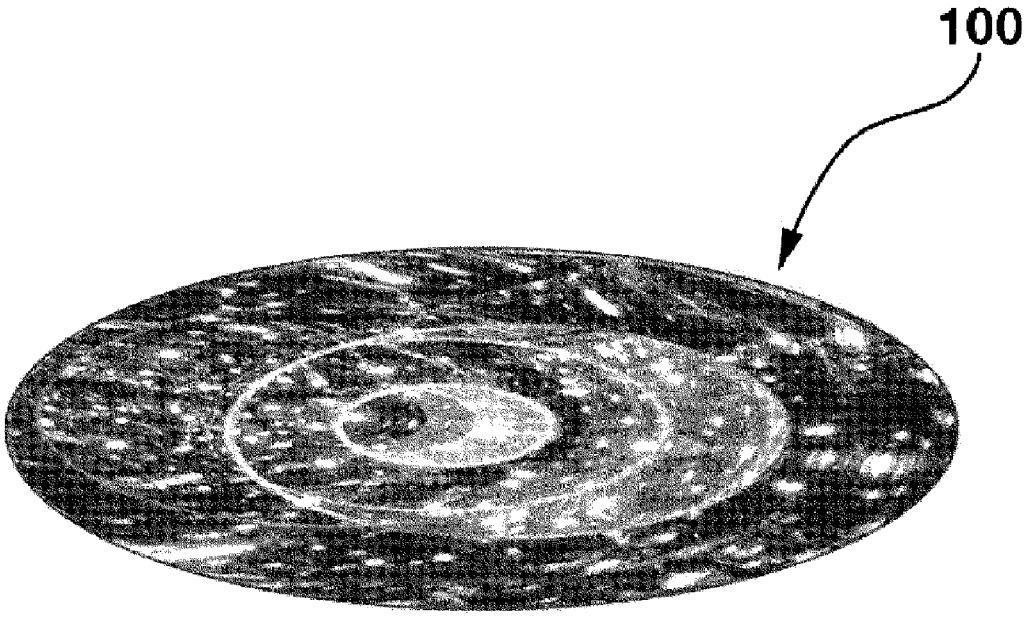
FIG. 13 shows an example in which a front shape is oval.
Figure 14:
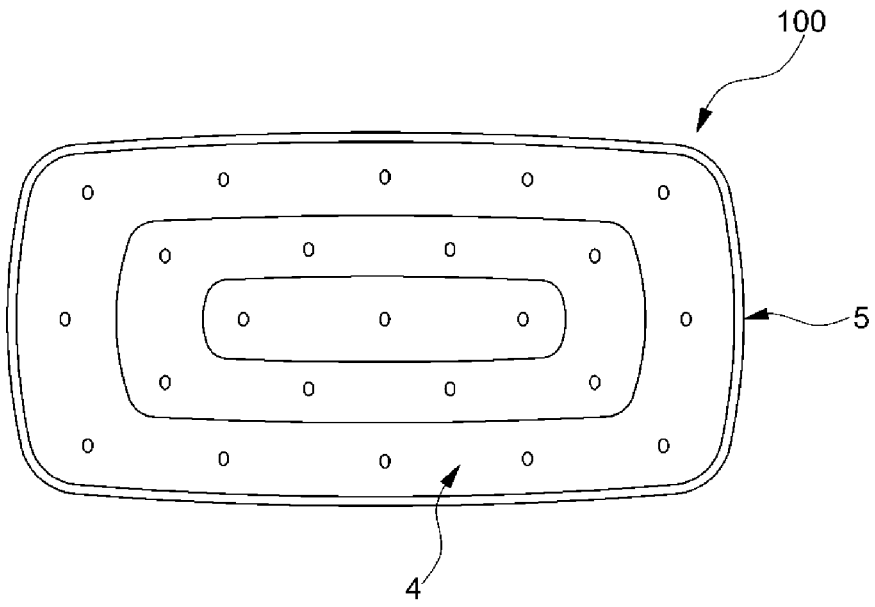
FIG. 14 is a front view of an example in which a front shape is square.
Figure 15:
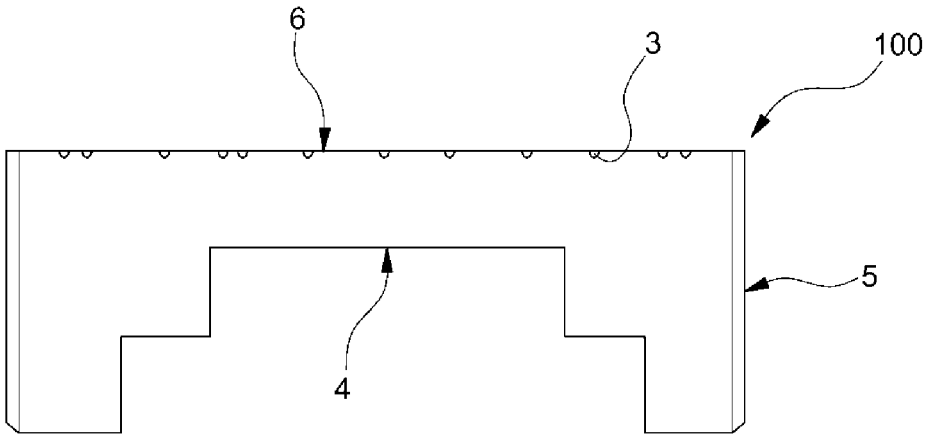
FIG. 15 is a cross-sectional view of FIG. 14.
Figure 16:
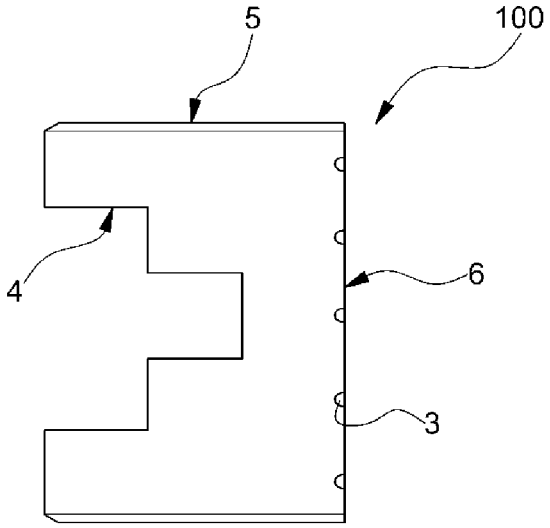
FIG. 16 is a longitudinal-sectional view of FIG. 14.
Figure 17:
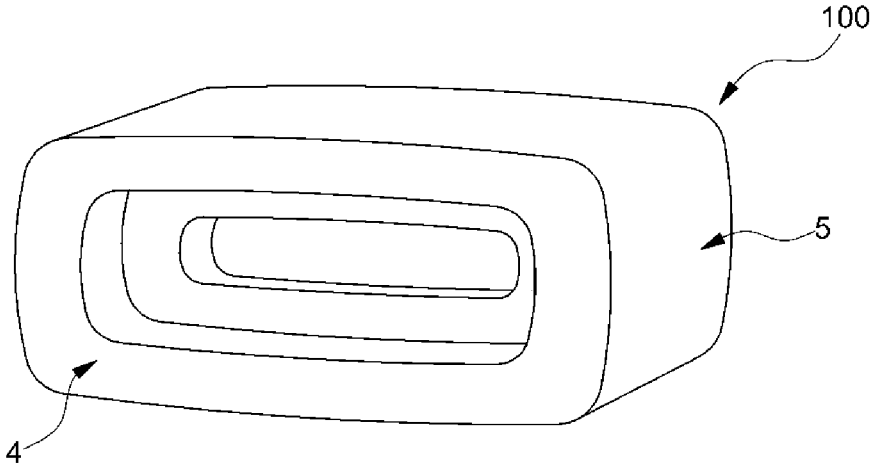
FIG. 17 is a perspective view of FIG. 14.

FIG. 13 shows an example in which a front shape is oval. Also with this shape, the lamp for a vehicle, which shines like shooting stars, can be realized.

Figure 18:
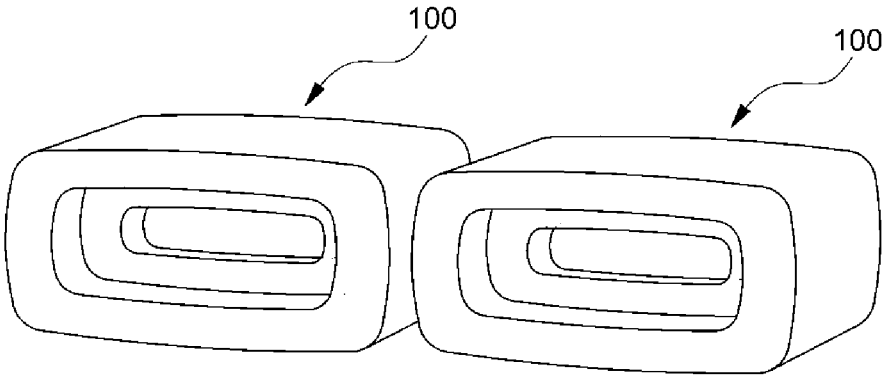
FIG. 18 shows an application example of disposition of 2 consecutive lamps.
Figure 19:
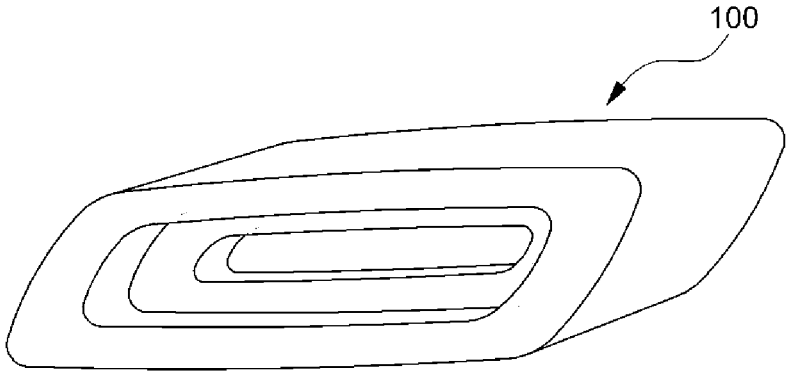
FIG. 19 is a perspective view of an example in which a front is diamond-shaped.
Figure 20:
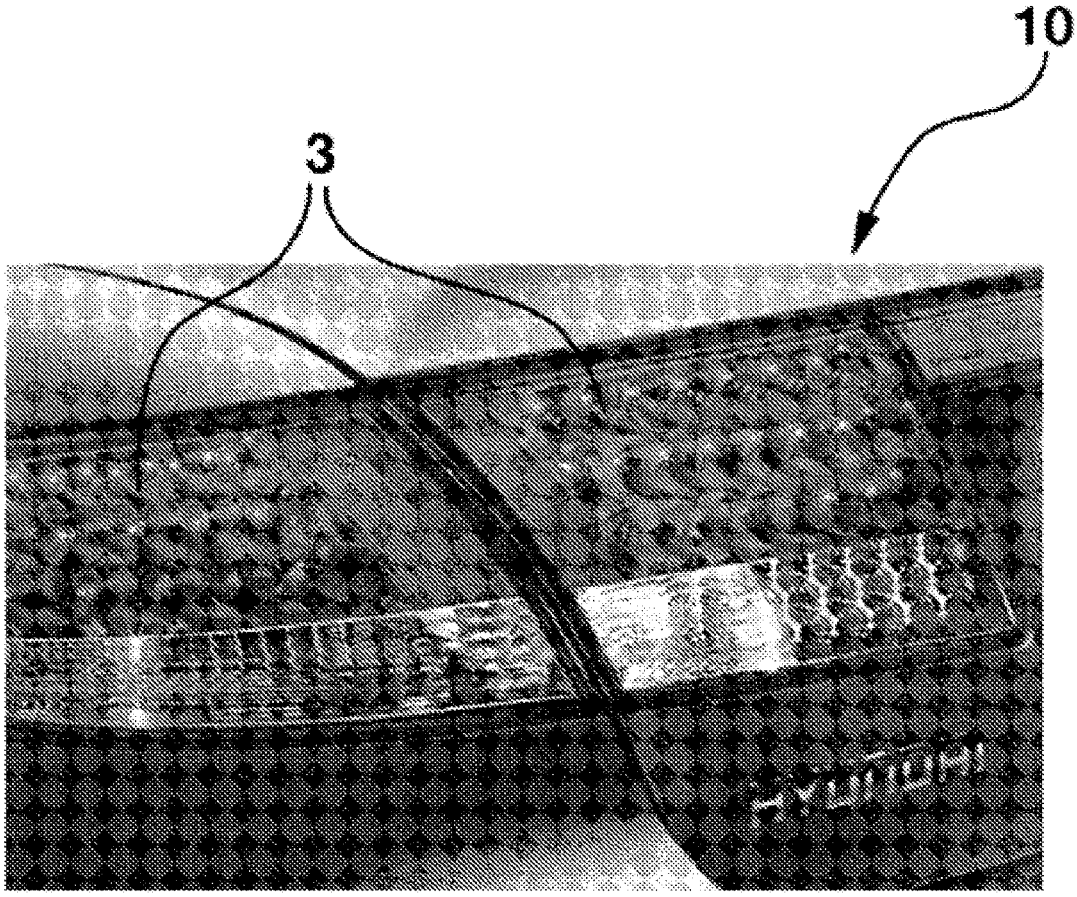
FIG. 20 (Related Art)
FIG. 20 shows a conventional LED head lamp.

FIGS. 14 through 17 show examples in which a front shape is square. The upper cover 4 is in a concave shape having an annular end portion like in FIG. 1. Also with this shape, the lamp for a vehicle, which shines like shooting stars, can be realized. The number of point light sources 3 is 23.FIG. 18 shows an application example of disposition of 2 consecutive lamps. As shown in FIG. 19, the front may be in a diamond shape.

The lamp for a vehicle according to an exemplary embodiment of the present invention uses LEDs as point light sources while reducing the number of LEDs, saves resources and power, and improves visibility, and may be very suitably used as the lamp for a vehicle. In addition, the lamp for a vehicle according to an exemplary embodiment of the present invention can be variously applied to a head lamp, an indoor lamp, a tail lamp for a vehicle, etc. In addition, the lamp can also be applied to an indoor lighting lamp (furniture), a signal mechanism, an electric light illumination signboard, an amusement machine (game player) such as a pachinko, and so forth, without being limited to the vehicle.

With the lamp for a vehicle according to an exemplary embodiment of the present invention, light from the point light sources is multiple-reflected from a flat surface between the upper cover and the lower cover, such that the point light sources may emit more light than actually possible. The upper cover and the lower cover are connected in the tub whose inner side is a mirror surface, and thus the light from the point light sources may shine like shooting stars and may be seen enlarged. In addition, it is not necessary to dispose a number of point light sources, thus cutting down the cost, saving the power, and improving visibility.

By forming the upper cover in a concave shape having an annular end portion, the end portion of the semi-mirror surface of the upper cover and the mirror surface of the tub are in parallel with each other, such that light going in perpendicular to the surface is multiple-reflected and thus a more number of point light sources may shine like shooting stars.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lamp apparatus for a vehicle, the lamp apparatus comprising:

a hollow tube having an inner side which is a mirror surface;

an upper cover which is mounted at a side of the tube and has a first surface perpendicular to an axial direction of the tube, wherein the first surface includes a semi-mirror surface which divides light into a transmitted light passing to the outside and a reflected light reflected to the inside;

a lower cover which is mounted at the other side of the tube and has a second surface perpendicular to the axial direction of the tube, wherein the second surface includes a mirror surface formed on an inner side thereof; and a plurality of point light sources mounted on the mirror surface of the lower cover;

wherein light emitted from the point light sources is multiple-reflected between the semi-mirror surface of the upper cover and the mirror surface of the lower cover; and wherein the first surface is formed with a plurality of annular end portions and aligned in a stepped shape.

2. The lamp apparatus of claim 1, wherein the point light sources are spaced each other.

3. The lamp apparatus of claim 1, wherein the upper cover is formed in a concave shape toward the lower cover.

4. The lamp apparatus of claim 3, wherein the second surface of the lower cover is flat.

5. The lamp apparatus of claim 1, wherein the upper cover is formed in a convex shape in a direction opposite to the lower cover and the first surface is formed of an annular end portion.

6. The lamp apparatus of claim 5, wherein the first surface is formed with a plurality of annular end portions and aligned in a stepped shape.

7. The lamp apparatus of claim 5, wherein the second surface of the lower cover is flat.

8. The lamp apparatus of claim 5, wherein the lower cover is formed in a convex shape toward the upper cover and the second surface is formed of an annular end portion.

9. The lamp apparatus of claim 8, wherein the second surface is formed with a plurality of annular end portions and aligned in a stepped shape.

10. The lamp apparatus of claim 1, wherein the upper cover is flat.

11. The lamp apparatus of claim 10, wherein the lower cover is formed in a convex shape toward the upper cover and the second surface is formed of an annular end portion.

12. The lamp apparatus of claim 11, wherein the second surface is formed with a plurality of annular end portions and aligned in a stepped shape.

* * * * *

UNITED STATES PATENT AND TRADEMARK OFFICE

CERTIFICATE OF CORRECTION

PATENT NO. : 8,783,926 B2
APPLICATION NO. : 13/611477
DATED : July 22, 2014
INVENTOR(S) : Hiroshi Suzuki It is certified that error appears in the above-identified patent and that said Letters Patent is hereby corrected as shown below:

Title Page, item (73) in the Assignees:

After "Hyundai Motor Japan R&D Center Inc.," delete "Seoul (KR)" and insert --Yokohama (JP)--;

After "Kia Motors Corporation," delete "Yokohama (JP)" and insert --Seoul (KR)--.

Signed and Sealed this
Thirtieth Day of September, 2014

Michelle K. Lee

Michelle K. Lee
*Deputy Director of the United States Patent and Trademark Office*